US007303309B2

(12) United States Patent
Wu et al.

(10) Patent No.: US 7,303,309 B2
(45) Date of Patent: Dec. 4, 2007

(54) METHOD AND APPARATUS FOR BACKLIT SIGNS WITH LIGHT EMITTING DIODE MODULES

(75) Inventors: Chen H. Wu, Los Altos Hills, CA (US); Steve Bacilieri, Hunt, TX (US)

(73) Assignee: Leotek Electronics Corporation, Santa Clara, CA (US)

( * ) Notice: Subject to any disclaimer, the term of this patent is extended or adjusted under 35 U.S.C. 154(b) by 0 days.

(21) Appl. No.: 10/886,798

(22) Filed: Jul. 6, 2004

(65) Prior Publication Data

US 2005/0039361 A1 Feb. 24, 2005

Related U.S. Application Data

(63) Continuation-in-part of application No. 10/452,672, filed on May 30, 2003, now Pat. No. 6,761,471.

(60) Provisional application No. 60/417,211, filed on Oct. 8, 2002.

(51) Int. Cl.
*F21V 1/00* (2006.01)
*F21V 11/00* (2006.01)

(52) U.S. Cl. ..... 362/240; 40/441; 40/442; 40/204; 40/570; 40/572; 40/546

(58) Field of Classification Search ..... 362/800, 362/812, 240; 40/441–444, 204–206, 570, 40/544, 582, 572, 546, 564
See application file for complete search history.

(56) References Cited

U.S. PATENT DOCUMENTS 3,591,941 A * 7/1971 Jaffe, Jr. ..... 40/546
4,385,343 A * 5/1983 Plumly ..... 362/614
4,561,203 A * 12/1985 MacDonald et al. ..... 40/570
4,587,755 A * 5/1986 Sunshine ..... 40/571
4,733,486 A * 3/1988 Gawell ..... 40/451
4,941,074 A * 7/1990 DeCosse et al. ..... 362/511
4,951,406 A * 8/1990 Lemire ..... 40/576
5,276,591 A * 1/1994 Hegarty ..... 362/601
5,388,357 A 2/1995 Malita
5,410,453 A 4/1995 Ruskouski
5,416,679 A 5/1995 Ruskouski et al.
5,428,912 A 7/1995 Grondal et al.
5,459,955 A 10/1995 Ruskouski et al.
5,526,236 A 6/1996 Burnes et al.
5,650,340 A * 7/1997 Burr et al. ..... 438/286
5,688,042 A 11/1997 Madadi et al.
5,949,247 A 9/1999 Lima et al.
6,024,462 A * 2/2000 Whitehead ..... 362/618

(Continued)

*Primary Examiner*—Jong-Suk (James) Lee
*Assistant Examiner*—Jacob Y Choi
(74) *Attorney, Agent, or Firm*—DLA Piper US LLP

(57) ABSTRACT

A backlit sign with an LED module, with a housing that includes a top wall having a first length, a bottom wall having a second length, and a pair of opposing sidewalls each having a third length, wherein at least a portion of one of the sidewalls is translucent. One or more LED modules are mounted to the top wall and include a plurality of LEDs for producing light. The first, second and third lengths are selected to maximize illumination of the sidewalls by the produced light, and to minimize a width and weight of the sign. A mirror can be used to increase the reflectivity of the bottom wall.

2 Claims, 7 Drawing Sheets

U.S. PATENT DOCUMENTS 6,026,602 A * 2/2000 Grondal et al. ..... 40/570
6,036,336 A 3/2000 Wu
6,305,109 B1 * 10/2001 Lee ..... 40/546
6,471,388 B1 * 10/2002 Marsh ..... 362/559
6,481,130 B1 * 11/2002 Wu ..... 40/546
6,558,021 B2 5/2003 Wu et al.
6,761,475 B2 * 7/2004 Perlo et al. ..... 362/511
6,805,476 B2 * 10/2004 Amano ..... 362/545
6,981,784 B2 * 1/2006 Dubuc ..... 362/331

* cited by examiner

METHOD AND APPARATUS FOR BACKLIT SIGNS WITH LIGHT EMITTING DIODE MODULES

This application is a continuation in part application of U.S. application Ser. No. 10/452,672, filed May 30, 2003, now U.S. Pat. No. 6,761,471 which claims the benefit of U.S. Provisional Application No. 60/417,211, filed Oct. 8, 2002.

FIELD OF THE INVENTION

The present invention relates to light emitting diode (LED) modules, and more particularly to an LED module for commercial and street name signs presently illuminated with fluorescent tube lighting.

BACKGROUND OF THE INVENTION

Light emitting diodes (LEDs) have been widely used in many applications to replace conventional incandescent lamps, fluorescent lamps, neon tube lamps and fiber optic lights. LEDs consume much less electrical power, are far more reliable, and exhibit much longer lifetimes, than their conventional counterparts. As a result, LEDs have been configured to replace conventional light sources for many applications. For example, LED lamps have been developed to replace screw-in incandescent light bulbs for traffic signals (as shown in U.S. Pat. No. 6,036,336), and exit signs (as shown in U.S. Pat. Nos. 5,416,679, 5,459,955, 5,526,236, 5,688,042, 5,949,347). In each case, the LEDs are mounted onto a lamp housing having a conventional threaded electrical connector that engages with the threaded socket connector in the traffic signal lamp or exit sign. Thus, retrofitting the traffic signal and exit signs simply involves unscrewing the conventional lamp and screwing in the LED lamp.

Retrofitting with LED lamps the vast numbers of backlit commercial and street name signs, which utilize fluorescent lighting, is more problematic. These signs typically include a housing containing one or more fluorescent tube lamps, and one or more translucent face plates (sidewalls) that are back-illuminated by the fluorescent lamp(s) (i.e. to form characters, designs, symbols, etc.). FIGS. 1A and 1B illustrate a conventional backlit street name sign, which includes a housing 1, a pair of fluorescent tube lamps 2 and a pair of opposing translucent face plates 3 that indicate a street name. Each of the fluorescent tube lamps 2 are connected to and suspended by a pair of electrical connectors 4, which are well known in the art. The face plates 3 are angled slightly downwardly for better viewing from below. FIGS. 2A and 2B illustrate a convention backlit commercial sign, where there is only a single translucent face plate 3 (which is not angled downwardly), and three fluorescent tube lamps 2 for illumination.

Replacing the short-lifespan fluorescent tube lamps in conventional backlit commercial and street name signs can be difficult, because such signs are typically elevated and inaccessible, disposed over roadways, and/or hard to open. What is worse is that there is no standard size for such signs, for the fluorescent tube lamps 2 used therein, and for the spacing between the electrical connectors 4. Thus, designing an LED lamp retrofit that fits a wide variety of such signs, that evenly and sufficiently illuminates such signs, and that is easy to install without the need for special tools, has been difficult. Adding to that difficulty is the fact that many such signs are suspended in a way that the sign rocks, vibrates and shakes in the wind.

There is a need for a versatile LED lamp design for retrofitting conventional backlit commercial and street name signs that is easy to install and fits in a variety of sign sizes and configurations. There is also a need for a backlit sign design that minimizes size and weight, while maximizing even illumination.

SUMMARY OF THE INVENTION

The present invention solves the aforementioned problems by providing an LED lamp design and method for conveniently retrofitting conventional backlit signs. The present invention also provides a new or retrofitted sign design that minimize the sign size and weight, while maximizing its illumination.

The present invention is a sign that includes a housing having a top wall having a first length, a bottom wall having a second length, and a pair of opposing sidewalls each having a third length, wherein at least a portion of one of the sidewalls is translucent, and a first LED module mounted to the top wall and including a plurality of LEDs for producing light, wherein the first, second and third lengths are selected to maximize illumination of the sidewalls by the produced light, and to minimize a width and weight of the sign.

Other objects and features of the present invention will become apparent by a review of the specification, claims and appended figures.

DETAILED DESCRIPTION OF THE PREFERRED EMBODIMENTS

Figure 1A:
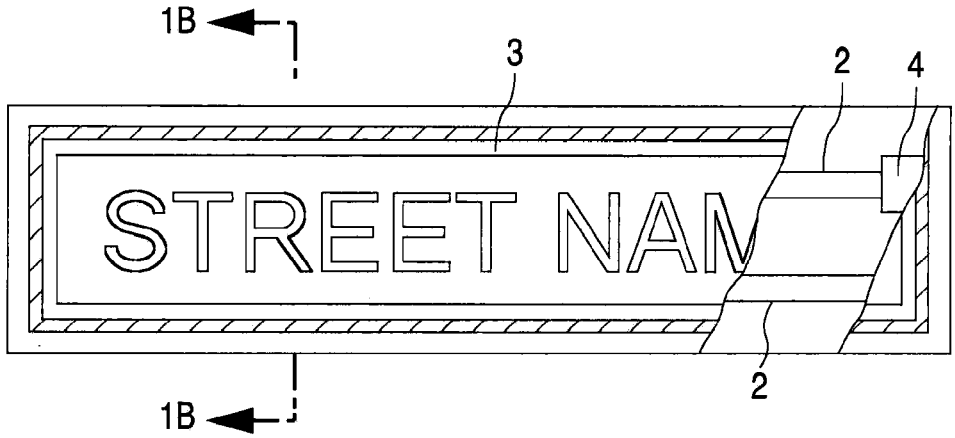
FIG. 1A (PRIOR ART)
FIG. 1A is a partially broken away side view of a conventional backlit street name sign.

The present invention is an LED module that mounts in conventional backlit commercial and street name signs. The LED module 10 is illustrated in FIGS. 3A and 3B, and includes one or more LED arrays 12, a pair of side support arms 14, a pair of mounting mechanisms 16, and a power supply 18.

Figure 1B:
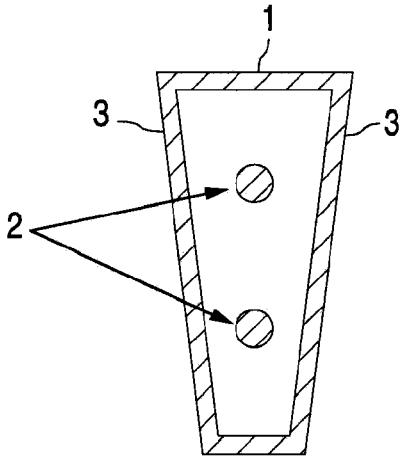
FIG. 1B (PRIOR ART)
FIG. 1B is a side cross-section view of the conventional backlit street name sign taken along line 1B-1B in FIG. 1A.
Figure 2B:
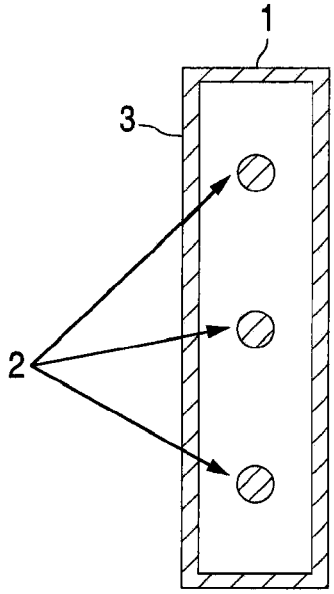
FIG. 2B (PRIOR ART)
FIG. 2B is a side cross-section view of the conventional backlit commercial sign taken along line 2B-2B in FIG. 2A.
Figure 2A:
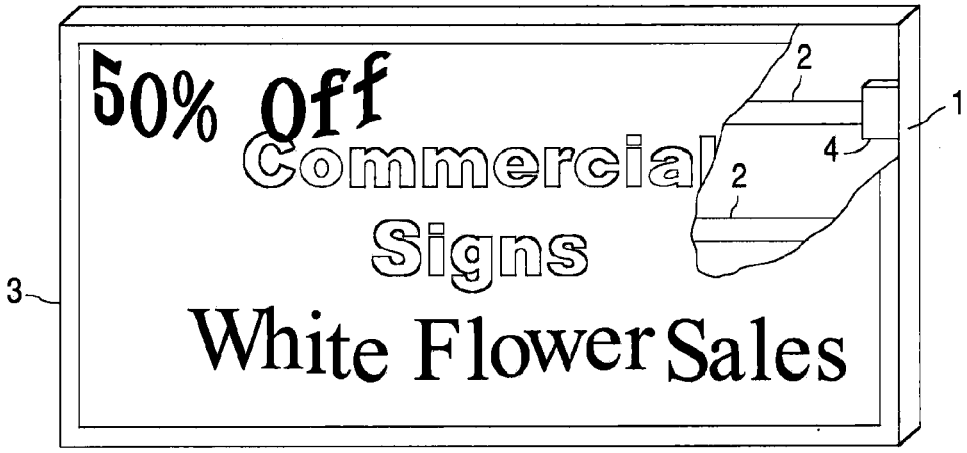
FIG. 2A (PRIOR ART)
FIG. 2A is a partially broken away side view of a conventional backlit commercial sign.

Each LED array 12 includes a support member 20 (which can act as a heat sink) having one or more mounting surfaces 22 on which a plurality of outward facing light emitting diodes (LEDs) 24 are mounted. If the LED module 10 is for use with a double sided sign (one having two opposing translucent plates), then the support member 20 preferably includes two mounting surfaces 22 on opposing sides of the support member 20, as shown in FIG. 3B. If the sign also has downwardly angled translucent plates (e.g. see FIG. 1B, where plates are not parallel to each other), then the mounting surfaces 22 can be downwardly angled (as shown in FIG. 3B, where surfaces 22 generally face in opposite directions but are not parallel to each other) so that LEDs 24 mounted thereon are directly facing the angled translucent plates (i.e. each mounting surface is parallel to the translucent plate it faces). The LEDs can be mounted on the mounting surfaces in any appropriate configuration, such as the linear configuration illustrated in FIG. 3A (i.e. a linear array of LEDs), where the LEDs provide a high output intensity and a wide viewing angle.

Figure 3A:
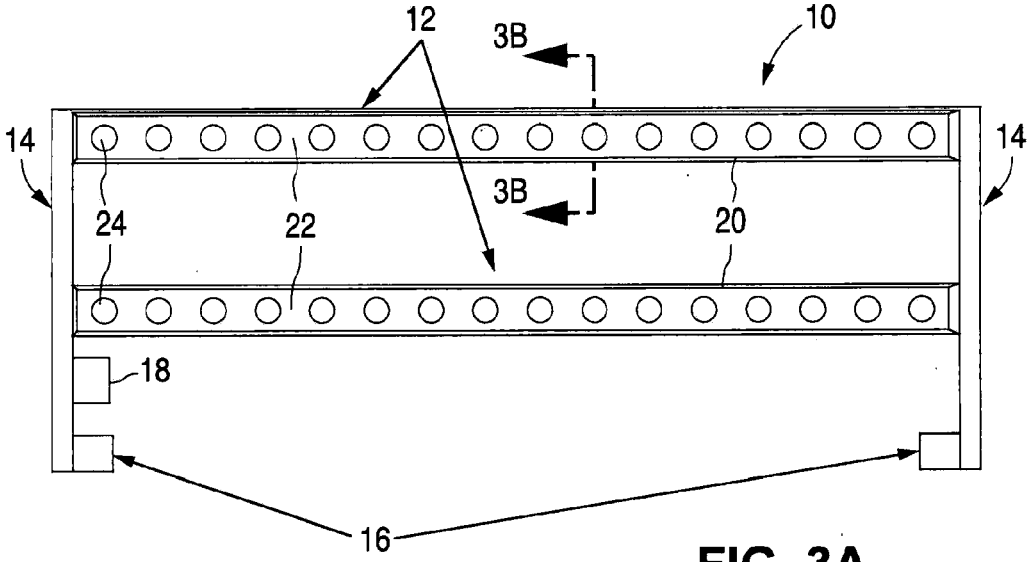
FIG. 3A is a side view of the LED module of the present invention.
Figure 3B:
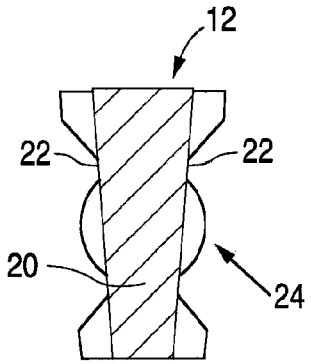
FIG. 3B is an end cross-section view of the LED array of the present invention, taken along line 3B-3B in FIG. 3A.

The support arms 14 are attached to and support the ends of the support members 20, as shown in FIG. 3A. Support arms 14 can be made of any rigid material, and preferably include electrical connections, wiring or conductive material or components to convey electrical power from the power supply 18 to the LEDs 24. The size of the LED module 10, as well as the number of LED arrays 12 and the number of LEDs 24 in each array, are selected to fit and properly illuminate the sign to be retrofitted.

Figure 4:
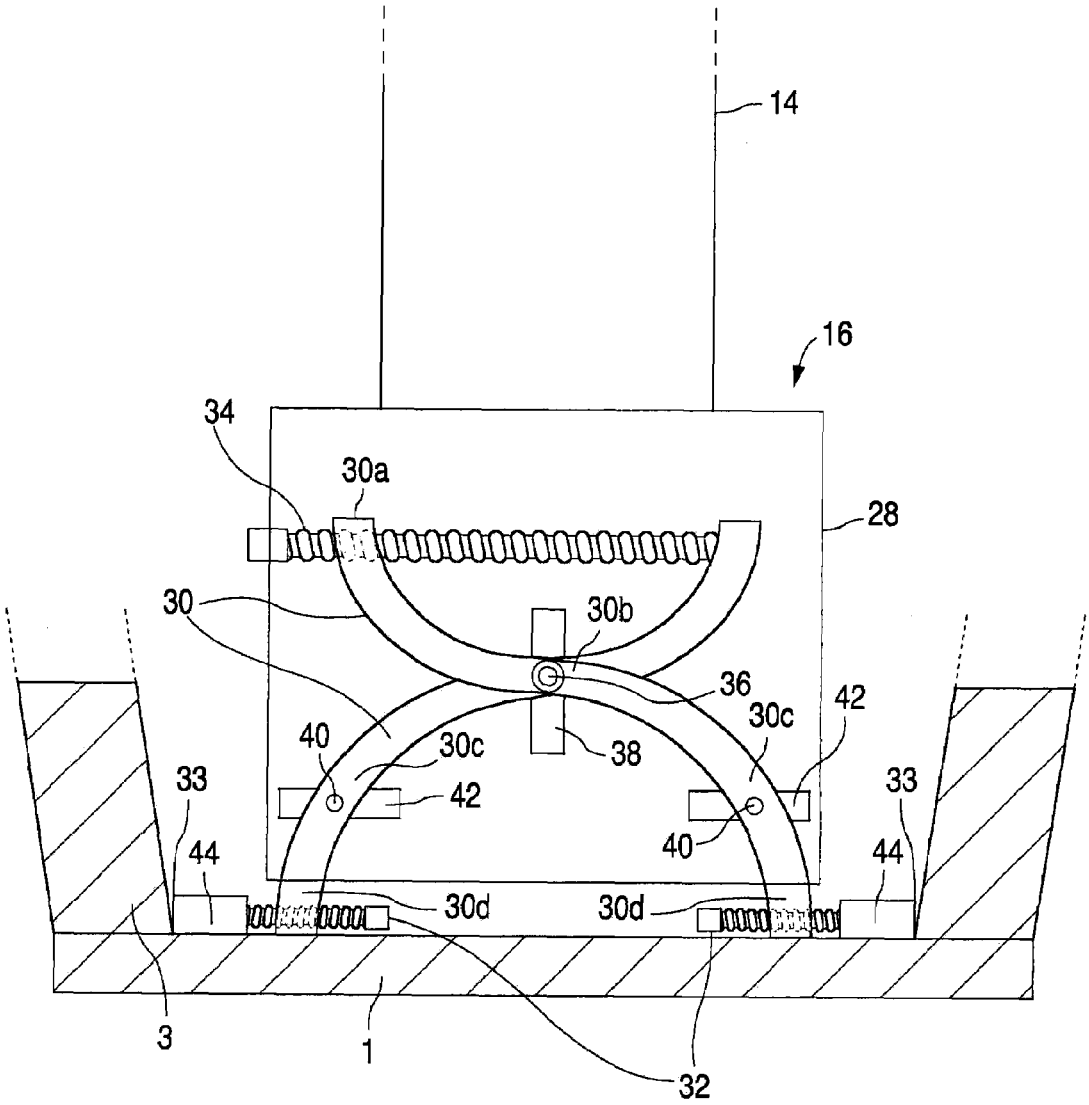
FIG. 4 is a side view of the mounting mechanism of the present invention.

The mounting mechanism 16 is best shown in FIG. 4, and includes a mounting member 28 either rigidly connected to or integrally formed as part of one of the support arms 14, a pair of scissor arms 30, a pair of adjustment screws 32, and a tightening screw 34. The scissor arms 30 are preferably S-shaped, and each includes an upper portion 30*a*, a mid-portion 30*b*, a lower mid portion 30*c*, and a lower portion 30*d*. The scissor arm mid portions 30*b* are rotatably connected together by a bolt 36 that extends through a vertical slot 38 formed in the mounting member 28. For each scissor arm 30, a bolt 40 extends from its lower mid-portion 30*c* and through a horizontal slot 42 formed in the mounting member 28. Each of the adjustment screws 32 is threaded through the lower portion 30*d* of one of the scissor arms 30, and terminates in an engagement surface 33. In the preferred embodiment, each adjustment screw 32 includes an engagement block of material 44 conducive to forming a friction fit (e.g. compressible or course materials, etc), with the engagement surface 33 at the end of the engagement block 44. The tightening screw 34 is threaded through one of the scissor arm upper portions 30*a*, and is rotatably engaged with the other scissor arm upper portion 30*a*. Each of the screws 32/34 includes a conventional adjustment end (Phillips, flat blade, Allen key, etc.) for rotation thereof, thus allowing the LED module 10 to be installed with no special tools (i.e. nothing more than just a screw driver or Allen key).

To retrofit a conventional backlit sign, its housing is opened and the fluorescent tube lamps therein are removed. The adjustment screws 32 of the LED module(s) to be inserted inside the sign are adjusted so that the engagement surfaces 33 for each pair of adjustment screws 32 are separated slightly less than the interior depth of the sign's housing at its base. After the LED module is placed inside the sign housing, each of the mounting mechanisms are operated by rotating its tightening screw 34 to separate the scissor arm upper portions 30*a* from each other, which also separates the lower portions 30*d* from each other as well, thus driving the engagement surfaces 33 away from each other and against the sign's sidewalls to form a secure friction fit therebetween. As the tightening screw 34 is adjusted, the bolts 36/40 slide in slots 38/42 to accommodate the movement of the scissor arms 30, while minimizing the vertical movement of the mounting member 28 during installation. Bolts 36/40 secure the scissor arms to the mounting member 28, to ensure support arm 14 cannot move relative to the sign's housing once installation is complete. The minimum sign depth compatible with the mounting mechanism is dictated mainly by the sizes of the mounting member 28 and scissor arms 30, and the maximum sign depth compatible with the mounting mechanism 16 is dictated mainly by the length of the adjustment screws 32 (i.e. how far the engagement surfaces 33 can be separated). Thus, a single sized mounting mechanism 16 can be compatible with a very large range of sign depths. Shorter or longer adjustment screws 32 can be swapped in/out of scissor arms 30 to vary the range of compatible sign depths even further.

Once the LED module is affixed to the sign housing using the mounting mechanism, the power supply 18 is electrically connected to the sign's electrical supply. This can be done by hard wiring the power supply 18 to the sign's electrical supply wiring. If space is needed, the sign's conventional fluorescent tube lamp electrical connector 4 may be removed from the sign. Alternately, the power supply 18 can include a power cord that terminates in an electrical connector that is compatible with and connects to the electrical connector 4 already present in the sign, negating the need for any hardwiring.

Figure 5A:
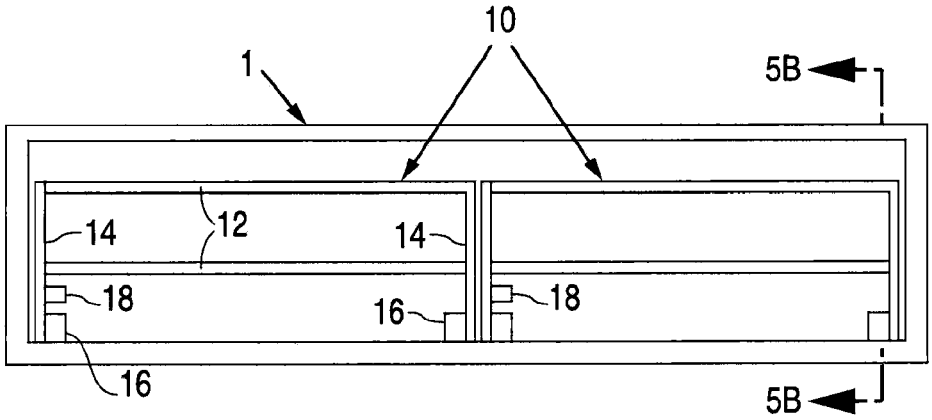
FIG. 5A is a side view of a conventional backlit sign retrofitted with the LED modules of the present invention.
Figure 5B:
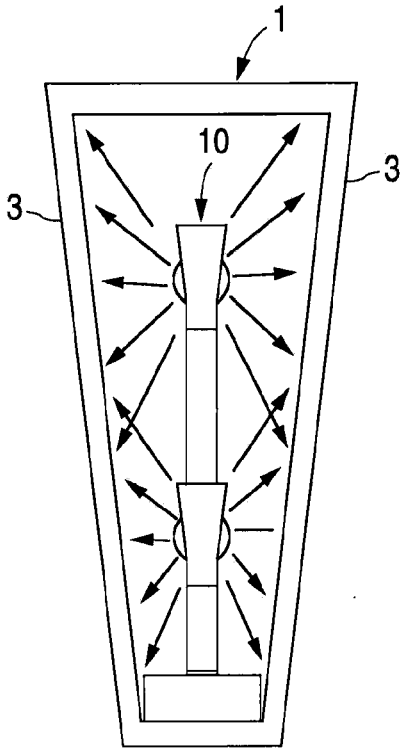
FIG. 5B is an end cross-sectional view of a conventional backlit sign retrofitted with the LED modules of the present invention.

FIGS. 5A and 5B illustrate the LED module of the present invention mounted inside a conventional backlit sign. Two LED modules 10 are placed end to end inside the sign housing 1, although any number and orientation of LED modules 10 can be used depending upon the sign's dimensions and lighting requirements. The pair of LED modules 10 can share a single power supply 18, or each include a dedicated power supply 18 as shown in FIG. 5A. Conventional street name signs typically have a height of about 18 inches, a depth of 6 to 12 inches (typically larger at the top of the sign), and a length of about 4 to 10 feet. Thus, the LED modules 10 of the present invention used to retrofit existing street name signs preferably have a length of 1 to 3 feet, and a height of about 15 inches. The number of LED modules 10 and their dimensions should be such that light from the LEDs brightly and evenly illuminates the entire face plate(s) 3.

Figure 6A:
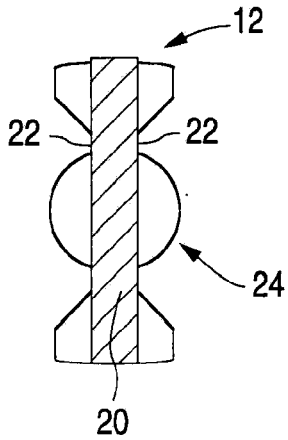
FIG. 6A is an end cross-sectional view of the LED array of the present invention, with parallel mounting surfaces.
Figure 6B:
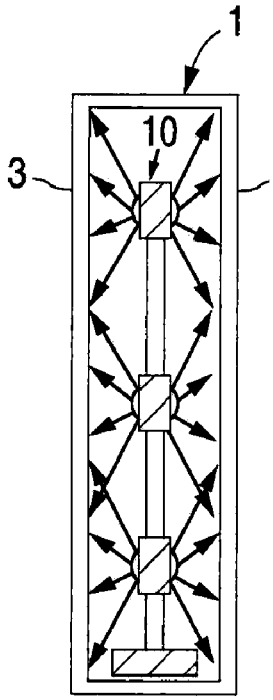
FIG. 6B is an end cross-sectional view of a conventional backlit sign retrofitted with the LED array shown in FIG. 6A.

FIGS. 6A and 6B illustrate the LED module of the present invention mounted inside a commercial double sided backlit sign, where the opposing face plates 3 are parallel to each other. In such a case, the LED array support members 20 each include two mounting surfaces 22 on opposing sides of the support member that are parallel to each other, so the LEDs 24 mounted thereon directly face the opposing translucent face plates 3. Typical backlit commercial signs are 1 to 10 feet in height and length, and 4-12 inches in depth.

Figure 7A:
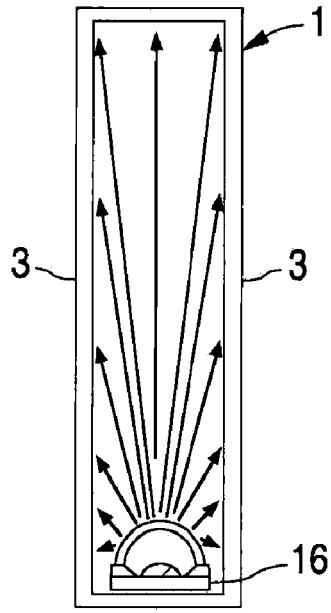
FIG. 7A is an end cross-sectional view of a conventional backlit sign retrofitted with an alternate embodiment of the LED module of the present invention.
Figure 7B:
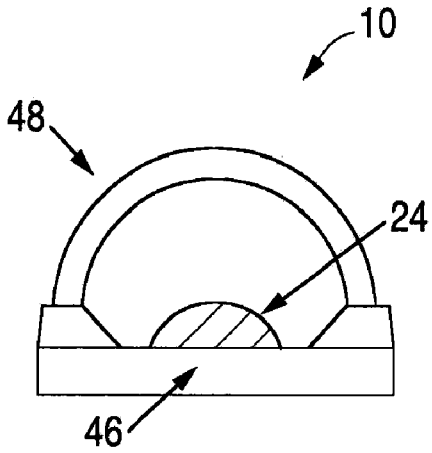
FIG. 7B is an end cross-sectional view of the alternate embodiment of the LED module of the present invention.
Figure 8A:
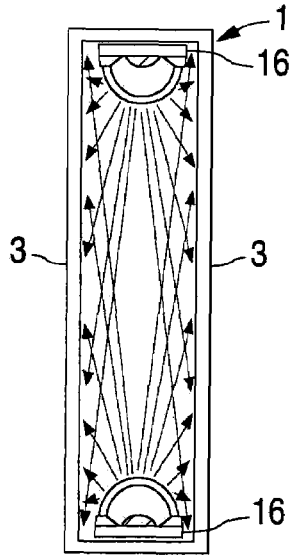
FIG. 8A is an end cross-sectional view of a conventional backlit sign retrofitted with a plurality of the LED module shown in FIG. 7B.
Figure 8B:
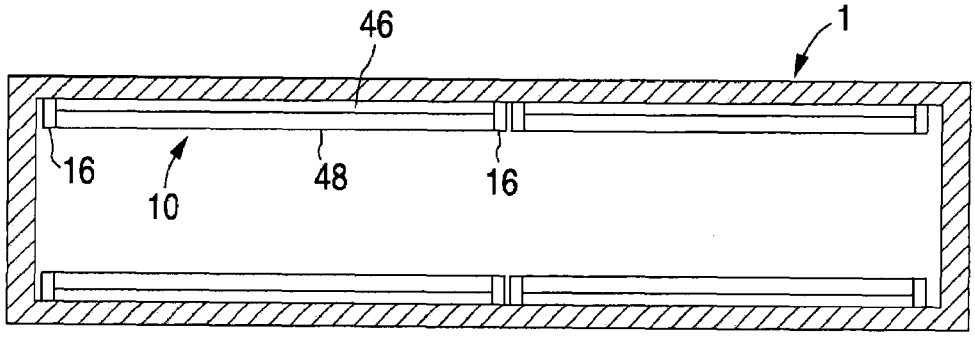
FIG. 8B is a side cross-sectional view of a conventional backlit sign retrofitted with a plurality of the LED module shown in FIG. 7B.

FIGS. 7A and 7B illustrate an alternate embodiment of the LED module 10, where the LEDs 24 are mounted to a base plate 46 (which can act as a heat sink), and an optical lens 48 is disposed over the LEDs 24. This embodiment of LED module 10 is installed along one or more of the sign's interior housing walls, as shown in FIG. 7A. The lens 48 disperses the light from the LEDs to evenly illuminate the sign's translucent face plate(s) 3. Depending on the sign's size and illumination requirements, several LED modules of this type can be installed inside the sign housing, for example along two or more housing sides, as illustrated in FIGS. 8A and 8B. This embodiment is ideal for signs that are subjected to excessive movement or vibrations, as it eliminates the need for long support arms extending from the periphery of the sign's housing.

There are numerous advantages of the present invention. The LED modules of the present invention can be easily and quickly installed into conventional backlit signs, often requiring nothing more than just a screw driver. A single LED module is compatible with a very wide range of sign depths. The installed LED modules will not become loose within the sign housing over time, even with sign movement or vibration.

Figure 9:
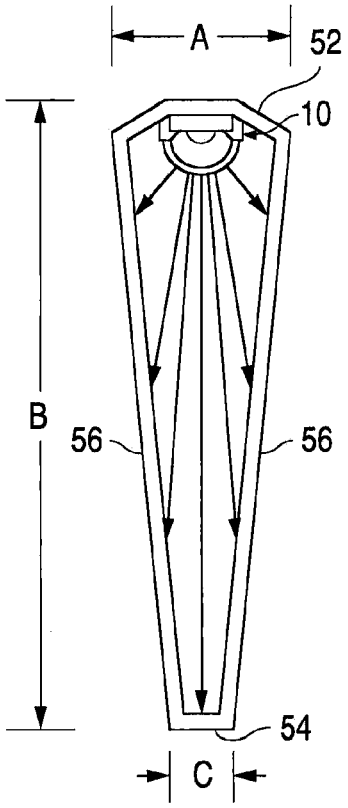
FIG. 9 is an end cross-sectional view of the backlit LED module sign of the present invention.

FIG. 9 illustrates an alternate embodiment of a new or retrofitted sign, where the housing 50 has dimensions selected to minimize the sign size and weight, while maximizing its illumination. Specifically, the housing includes top and bottom walls 52/54, and sidewalls (faceplates) 56, where housing as an upper width A (i.e. top wall 52 has length A), a height B (i.e. sidewalls 56 have a length B), and a lower width C (i.e. bottom wall 54 has length C), selected to maximize the illumination of sidewalls 56, while also minimizing size (mainly width) and weight. Ideally, a single LED module 10 is attached to the top wall 52 to illuminate the sign. For example, upper width A can vary between 1-12 inches, height B can vary between 12 and 120 inches, and lower width C can vary between 0 and 6 inches.

Figure 10:
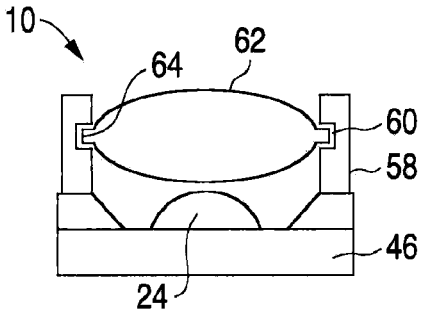
FIG. 10 is an end cross-sectional view of another alternate embodiment of the LED module of the present invention.

FIG. 10 illustrates an alternate embodiment of the LED module 10, which includes a sidewall 58 extending up from the base plate and including a notch 60. The lens 62 includes a flange 64 that engages with notch 60. This configuration provides for easier manufacture, and possible replacement of lens 62.

Figure 11:
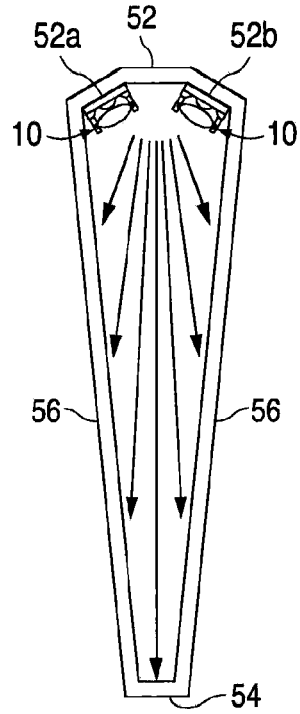
FIG. 11 is an end cross-sectional view of another embodiment of the backlit LED module sign of the present invention.
Figure 12:
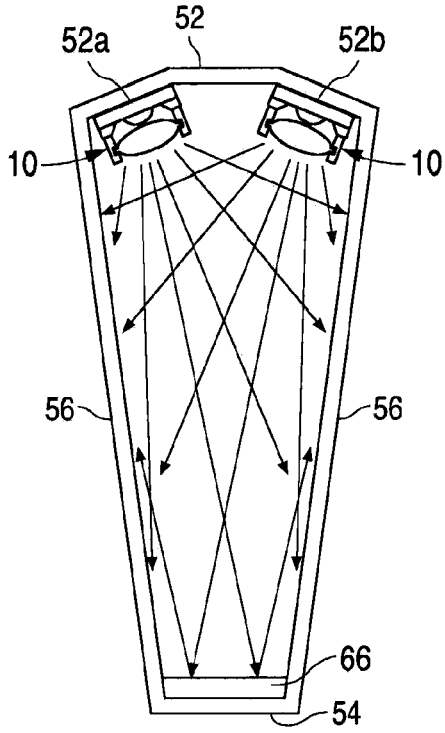
FIG. 12 is an end cross-sectional view of yet another embodiment of the backlit LED module sign of the present invention.

FIG. 11 illustrates an alternate embodiment of a new or retrofitted sign, where the top wall 52 includes two surfaces 52*a*/52*b* that are angled toward each other (not parallel) such that each surface 52*a*/52*b* faces toward one of the sidewalls 56 more than the other sidewall 56. A pair of LED modules 10 are mounted on the top wall 52, one on each of the surfaces 52*a*/52*b*. Each LED module 10 is oriented to direct a majority of the light generated therefrom onto the opposing sidewall 56. FIG. 12 illustrates a further enhancement of even illumination, by using a mirror 66 mounted on bottom wall 54 to redirect light back toward the sidewalls 56.

It is to be understood that the present invention is not limited to the embodiment(s) described above and illustrated herein, but encompasses any and all variations falling within the scope of the appended claims. For example, support member 20 could be two separate support members mounted back to back, or a composite structure that includes one or more PC boards mounted together or to a rigid material. Bolts 36/40 can be any rigid member (e.g. pins, rivets, etc.) that can slidably attach the scissor arms 30 to the mounting member 28 via slots 38/42. Only some (or even none) of the scissor arm lower portions may include the adjustment screws 32, in which case some (or even all) of the engagement surfaces may be on or attached to the scissor arm lower portions themselves (e.g. its outer side surface). Bolts 40 could extend from portions of scissor arms 30 above mid-portion 30*b* (and bolt 36), instead of below mid-portion 30*b* as shown in FIG. 4, if raising or lowering the height of the engagement surfaces relative to the mounting member 28 is not problematic. The power supply 18 could be incorporated inside the support member 20, so that each LED array 12 has its own power supply 18. The number of LED arrays 12 for each module 10, and the number and orientation of modules 10 in each sign, can vary to meet the lighting requirements of the sign. Lastly, for the purposes of this disclosure, references to a translucent face plate (sidewall) includes face plates (sidewalls) having portions that transmit light, with or without any diffusion, with or without any color filtering, and with or without opaque portions that form designs or characters.

What is claimed is:

1. An illuminated sign comprising:

a hollow housing that includes:

a top wall having a first length, a bottom wall having a second length, and a pair of opposing sidewalls each having a third length, wherein at least a portion of one of the sidewalls is translucent;

a first LED module disposed in the housing and mounted to the top wall and including a plurality of LEDs for producing light; and an optical lens disposed over the LED module for focusing the light produced by the LEDs;

wherein the first, second and third lengths are selected to maximize illumination of the sidewalls by the produced light, and to minimize a width and weight of the sign; and wherein:

the top wall includes first and second portions that are not coplanar with each other;

the first LED module is mounted to the top wall first portion; and the sign further comprising a second LED module mounted to the top wall second portion and having a plurality of LEDs for producing light.

2. The illuminated sign of claim 1, further comprising:

a mirror mounted to the bottom wall for reflecting the light produced by the first and second LED modules.

* * * * *